US006273768B1

(12) United States Patent
Blanchard

(10) Patent No.: US 6,273,768 B1
(45) Date of Patent: Aug. 14, 2001

(54) WATER JET PROPULSION UNIT WITH COUNTER-ROTATING IMPELLERS

(75) Inventor: Clarence E. Blanchard, Pleasant Prairie, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/545,483

(22) Filed: Apr. 7, 2000

(51) Int. Cl.[7] ..... B63H 11/00

(52) U.S. Cl. ..... 440/38; 440/38; 440/75; 440/79

(58) Field of Search ..... 440/38, 79, 80, 440/75; 416/128

(56) References Cited

U.S. PATENT DOCUMENTS

| | | | | |
|---|---|---|---|---|
| 132,288 | | 10/1872 | Hough . | |
| 2,064,195 | | 12/1936 | De Michelis | 170/165 |
| 2,987,031 | | 6/1961 | Odden | 115/37 |
| 3,083,529 | | 4/1963 | Hamilton | 60/35.54 |
| 3,561,392 | * | 2/1971 | Baez | 440/75 |
| 3,939,794 | | 2/1976 | Hull | 115/16 |
| 4,074,652 | | 2/1978 | Jackson | 115/35 |
| 4,642,059 | | 2/1987 | Nohara | 440/75 |
| 4,832,570 | | 5/1989 | Solia | 416/93 A |
| 4,840,136 | | 6/1989 | Brandt | 440/78 |
| 5,030,149 | | 7/1991 | Fujita | 440/75 |
| 5,087,230 | | 2/1992 | Yates et al. | 475/151 |
| 5,185,545 | | 2/1993 | Veronesi et al. | 310/114 |
| 5,249,995 | | 10/1993 | Meisenburg et al. | 440/81 |
| 5,289,068 | | 2/1994 | Veronesi et al. | 310/114 |
| 5,310,371 | | 5/1994 | Iriono et al. | 440/80 |
| 5,366,398 | | 11/1994 | Meisenburg et al. | 440/81 |
| 5,376,031 | | 12/1994 | Meisenburg et al. | 440/76 |
| 5,376,032 | | 12/1994 | Meisenburg et al. | 440/88 |
| 5,376,034 | | 12/1994 | Meisenburg et al. | 440/89 |
| 5,423,701 | | 6/1995 | Rodskier et al. | 440/81 |
| 5,618,213 | * | 4/1997 | Nanami | 440/38 |
| 5,634,831 | | 6/1997 | Davies et al. | 440/47 |

FOREIGN PATENT DOCUMENTS

| | | |
|---|---|---|
| 201985 | 3/1939 | (CH) . |
| 392672 A1 | 4/1991 | (DE) . |
| 385958 | 6/1908 | (FR) . |
| 444890 | 10/1912 | (FR) . |
| 93/01085 | 1/1993 | (WO) . |

OTHER PUBLICATIONS

Abstract of New Zealand Patent No. 123228, "Hydraulic Jet Propulsion Apparatus for Boats," C.W.F. Hamilton, Mar. 24, 1960, tyaken from Patent office Journal, Oct. 1960, p. 547.

* cited by examiner

*Primary Examiner*—Jesus D. Sotelo
(74) *Attorney, Agent, or Firm*—Dennis M. Flaherty

(57) ABSTRACT

A water jet apparatus with counter-rotating impellers for propelling a boat. The impellers are coupled by an assembly comprising an impeller shaft secured to a first impeller and a gear train coupling the impeller shaft to a second impeller for counter-rotation. Preferably the gear train comprises one beveled gear secured to the impeller shaft, another beveled gear secured to the second impeller, and a beveled pinion meshed with the first and second beveled gears. The counter-rotating impellers can be driven by a drive shaft coupled to the first impeller for boats having an inboard motor or by a drive shaft coupled to the pinion for boats having an outboard motor.

37 Claims, 2 Drawing Sheets

WATER JET PROPULSION UNIT WITH COUNTER-ROTATING IMPELLERS

FIELD OF THE INVENTION

This invention generally relates to water jet apparatus for propelling boats and other watercraft. In particular, the invention relates to mechanisms for impelling water through a flow-through housing of a water jet propulsion unit.

BACKGROUND OF THE INVENTION

It is known to propel a boat or other watercraft using a water jet apparatus mounted to the hull, with the powerhead being placed inside (inboard) or outside (outboard) the hull. The drive shaft of the water jet apparatus is coupled to the output shaft of the motor. The impeller is mounted on the drive shaft and installed in a housing, the interior surface of which defines a water tunnel having a convergent nozzle. The impeller is designed such that during motor operation, the rotating impeller impels water rearward through the water tunnel and out the convergent nozzle. The reaction force propels the boat forward.

In many water jet apparatus designs, the flow-through housing comprises an outer tubular section and a central hub, the outer tubular section and central hub being generally concentrically arranged to define a generally annular passageway downstream of the impeller. This passageway forms part of the water tunnel. The outer tubular section is sometimes referred to as the "stator housing" while the central hub is called the "stator hub". The stator hub typically rotatably supports the impeller shaft. The stator hub is supported inside the stator housing by a plurality of stator vanes or ribs which are curved to straighten the swirling water flowing downstream from the impeller. This straightening of the impelled water absorbs energy, resulting in a loss of efficiency of the water jet propulsion unit or pump. There is a need for a mechanism which would decrease the amount of energy lost due to flow straightening by the stator vanes.

SUMMARY OF THE INVENTION

The present invention is directed to a water jet apparatus having means for decreasing the amount of energy lost due to flow straightening by the stator vanes. In accordance with the preferred embodiments of the invention, this is accomplished by installing counter-rotating impellers in sufficiently proximal relationship such that the swirling effect produced by the upstream impeller is at least partially countered by the downstream impeller. In other words, the water flow exiting the downstream impeller has a smaller rotational component than the water flow exiting the upstream impeller. This impeller arrangement requires a less severe curvature of the straightening vanes, resulting in an increase in efficiency. In accordance with the preferred embodiment of the invention, the vanes have no curvature, i.e., are straight.

In accordance with the preferred embodiments, the counter-rotating impellers are coupled by an assembly comprising an impeller shaft secured to one of the impellers and a gear train coupling the impeller shaft to the other impeller for counter-rotation. Preferably the gear train comprises one beveled gear secured to the impeller shaft, another beveled gear secured to the second impeller, and a beveled pinion meshed with the first and second beveled gears. The counter-rotating impellers can be driven by a drive shaft coupled to the first impeller for boats having an inboard motor or by a drive shaft coupled to the pinion for boats having an outboard motor.

In accordance with an alternative preferred embodiment, the drive shaft and impeller shaft can be combined in a single shaft having the first impeller and the first beveled gear attached thereto, with the second impeller being attached to a sleeve of the second gear which is rotatable relative to the shaft and to a hub which encircles the gear train and defines the inner boundary surface of a water tunnel through which impelled water flows rearward.

In accordance with one preferred embodiment, the water jet propulsion unit comprises the following: a flow-through housing; a central hub supported inside the housing by a plurality of vanes; first and second gears rotatably mounted in the central hub; a pinion rotatably mounted in the central hub and meshed with the first and second gears such that rotation of the first gear causes rotation of the second gear; an impeller shaft coaxial with the first and second gears and having one portion connected to the first gear and another portion rotatable relative to the second gear.

The preferred embodiment of the invention will be disclosed in the context of water jet propulsion system which is driven by an inboard motor. However, the person skilled in the art will readily appreciate that the counter-rotating impellers disclosed herein have application beyond water jet propulsion systems driven by an inboard motor. For example, the counter-rotating impellers disclosed herein have application in a water jet propulsion system driven by an outboard motor.

DETAILED DESCRIPTION OF THE PREFERRED EMBODIMENTS

Figure 1:
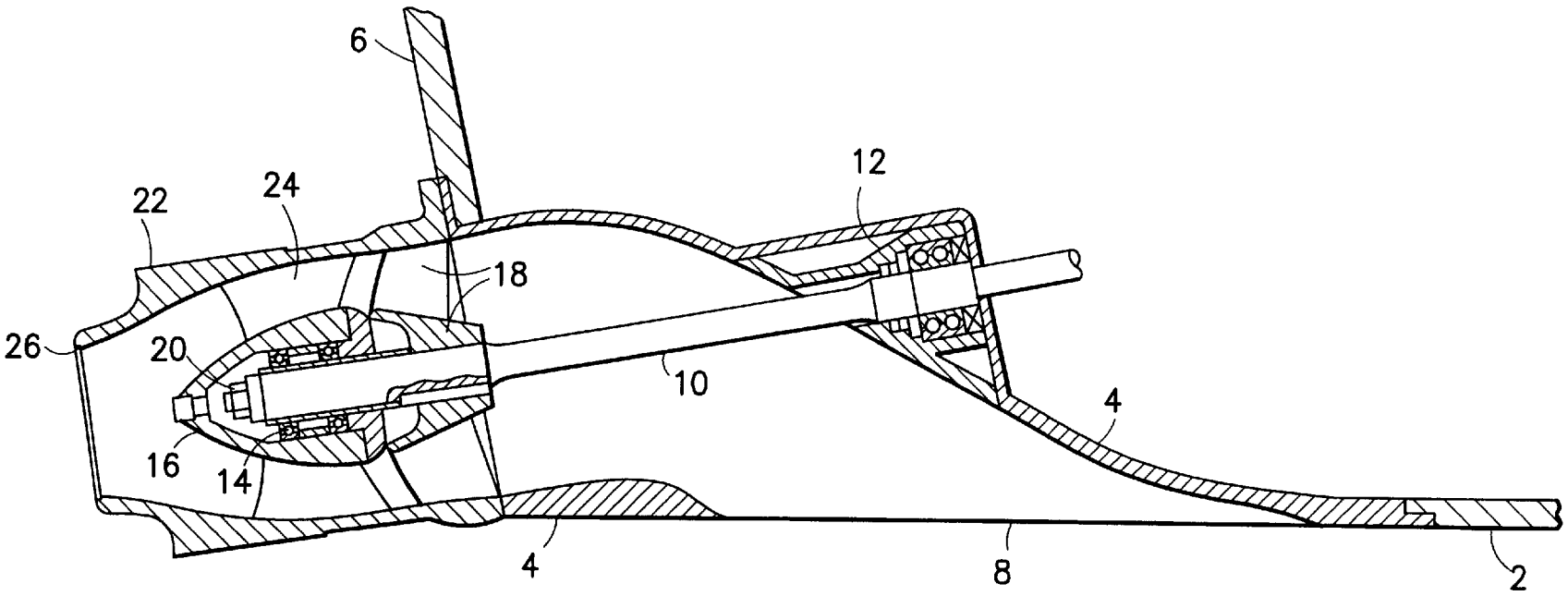
FIG. 1 PRIOR ART
FIG. 1 is a schematic showing an elevational sectional view of a conventional water jet propulsion system.

FIG. 1 depicts a conventional water jet apparatus mounted to a boat. The boat has a hull 2 with a water tunnel 4 installed in its stern. The water tunnel 4 has a height which gradually increases from its starting point to a maximum height located at the transom 6 of the hull 2. The water tunnel 4 is installed in an opening in the hull. The intake 8 of the water tunnel 4 lies generally in the plane of the bottom of hull 2 while the outlet of the water tunnel 4 lies generally in the plane of the transom 6.

In addition, the boat partially depicted in FIG. 1 comprises an outboard water jet propulsion unit having an inlet which is in flow communication with the outlet of the water tunnel 4. The water jet propulsion unit is powered by an inboard engine (not shown) by means of a drive shaft 10. The drive shaft 10 is rotatably mounted in a conventional fashion, e.g., by a first set of bearings installed in a bearing housing 12 mounted to the water tunnel and by a second set of bearings 14 installed in a stator hub 16 of the water jet propulsion unit.

An impeller 18 comprising a hub and a plurality of blades is mounted near the end of the drive shaft 10. The hub and blades of impeller 18 are preferably integrally formed as one cast piece. As indicated by the cutaway portion of the drive shaft 10 seen in FIG. 1, the hub of impeller 18 and the drive shaft 10 are keyed so that the impeller will rotate in unison with the driveshaft. Alternatively, the impeller hub can be provided with a splined bore which meshes with splines formed on the external surface of the drive shaft. The impeller 18 is held securely on the drive shaft 10 by means of a lock nut 20 tightened onto a threaded end of the drive shaft 10. As seen in FIG. 1, the hub of the impeller 18 increases in radius in the aft direction, transitioning gradually from a generally conical outer surface at the leading edge of the impeller hub to a generally circular cylindrical outer surface at the trailing edge of the impeller hub. This outer surface of the impeller hub forms the radially inner boundary for guiding the flow of water impelled by the impeller.

The water jet propulsion unit shown in FIG. 1 also comprises a stator housing 22 which surrounds the impeller blades. The inner surface of the stator housing 22 forms the radially outer boundary for guiding the flow of water impelled by the impeller. The stator housing 22 has an inlet in flow communication with the outlet of the water tunnel 4. The stator housing 22 is connected to the stator hub 16 by a plurality of curved stator or straightening vanes 24. The stator hub 16 gradually decreases in radius in the aft direction to form a bullet-shaped tail cone, starting out at a radius slightly less than the radius at the trailing edge of the impeller hub. The tail cone may comprise a separate piece attached to the stator hub. The stator vanes 24 are designed to redirect the swirling flow out of the impeller 18 into non-swirling flow, i.e., the stator vanes are designed to remove the rotating component from the water as it leaves the impeller and cause the water to flow directly rearward. As previously discussed, this straightening of the impelled water absorbs energy, resulting in a loss of efficiency of the water jet propulsion unit or pump.

The stator housing 22 comprises an exit nozzle having an outlet 26. Alternatively, the exit nozzle can be formed as a separate component which is attached to the stator housing. Although not shown in FIG. 1, it will be readily appreciated by persons skilled in the art that a steering nozzle can be pivotably mounted to the stator housing or exit nozzle for steering the boat by redirecting the flow exiting the nozzle outlet 26. Similarly, a reverse gate can be pivotably mounted to the steering nozzle, stator housing, or exit nozzle for shifting the boat into reverse by reversing the flow exiting the steering nozzle. Structures for providing steering and shifting capability are well known in the art and are not discussed in detail herein.

Figure 2:
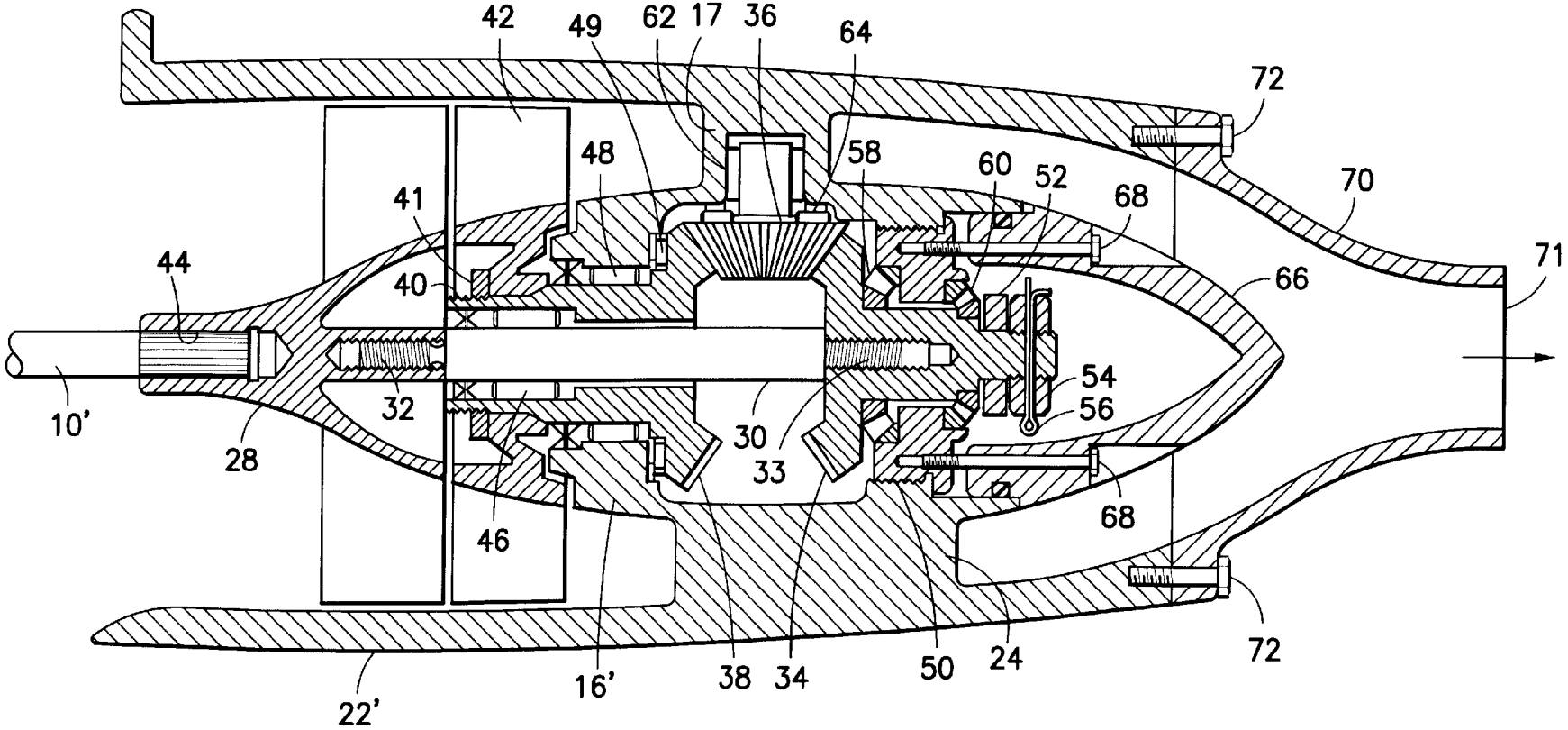
FIG. 2 is a schematic showing an elevational sectional view of a water jet propulsion device in accordance with the preferred embodiment of the invention.

A preferred embodiment of the invention in which the water jet propulsion unit is driven by an inboard motor (not shown) is depicted in FIG. 2. The unit comprises a stator housing or duct 22' which surrounds a stator or central hub 16'. The stator hub 16' is supported inside the stator housing 22' via a hollow strut 17 and a plurality of straight stator vanes 24 (only one of which is shown in FIG. 2), each stator vane preferably lying in a radial plane intersecting a centerline axis of the propulsion unit defined by the axis of an impeller shaft 30. However, the vanes may be curved to the extent needed to compensate for (i.e., straighten) any swirl in the impelled water.

The stator hub has a flange at its inlet for attachment to a water tunnel in the manner shown in FIG. 1. A tail cone 66 is attached to the hub 16' by means of a plurality of fasteners 68 which are screwed into threaded holes in a bearing retainer 50. A convergent exit nozzle 70 is attached at an outlet of the stator housing 22' by means of a plurality of fasteners 72. The external surfaces of the hub 16' and the tail cone 66 and the internal surfaces of the housing 22' and the exit nozzle 70 define a generally annular passageway for impelled water to flow toward the exit nozzle outlet 71.

The preferred embodiment further comprises an impeller shaft 30 which is coaxial with a drive shaft 10', the latter being connected to the output shaft (not shown) of an inboard motor. The impeller shaft 30 is threaded at both ends. The threaded end 32 of the impeller shaft 30 is threadably coupled to a threaded bore formed in the hub of a primary impeller 28. The hub of impeller 28 also has a splined bore 44 which is coaxial with the threaded bore and which receives a splined end of the drive shaft 10'. The circumferential external surface of the hub of impeller 28 has a diameter which increases smoothly from a minimum diameter to a maximum diameter in a rearward axial direction. The primary impeller 28 further comprises a plurality of impeller blades extending radially outward, the tips of the blades being disposed in proximal relationship to the internal surface of the opposing section of the stator housing 22'.

The other threaded end 33 of the impeller shaft 30 is threadably coupled to a threaded bore formed in a rear beveled gear 34. The rear beveled gear 34 further comprises a multiplicity of gear teeth (which mesh with the teeth of a beveled pinion 36) and a threaded rear projection, which receives a threaded locking nut 54. The rear beveled gear 34 is rotatably supported by a pair of tapered bearings 58 and 60, which are retained in position by a bearing retainer 50 threadably coupled to the stator hub 16' and a washer 52 held in position by the locking nut 54. The locking nut 54 is secured against being unscrewed by a cotter pin 56 which is inserted in aligned holes in the rear beveled gear 34 and locking nut 54.

The water jet propulsion unit in accordance with the preferred embodiment further comprises a secondary impeller 42 attached to a sleeve 40 of a forward beveled gear 38. The forward beveled gear 38 comprises a multiplicity of gear teeth which mesh with the beveled pinion 36. The secondary impeller 42 is positioned directly behind the primary impeller 28 coaxial therewith. The secondary impeller is held on the sleeve 40 by a threaded collar 41 which is threadably coupled to threads on the external surface of the sleeve. The forward beveled gear 38 is rotatably supported by needle bearings 46 and 48 and by radial thrust bearing 49. The bearings 46 and 48 are respectively sealed by lip seals: the bearing 46 and associated lip seal are arranged between the impeller shaft 30 and the sleeve 40 of front beveled gear 38, while the bearings 48 (and associated lip seal) and 49 are arranged between the front beveled gear 38 and the stator hub 16'. Bearing 46 rotatably supports the impeller shaft 30. The circumferential external surface of the hub of impeller 42 has a diameter which increases smoothly from a minimum diameter to a maximum diameter in the rearward axial direction, the minimum diameter of the circumferential external surface of the hub of secondary impeller 42 being substantially equal to or slightly greater than the maximum diameter of the circumferential external surface of the hub of primary impeller 28. Similarly, the circumferential external surface of the section of stator hub 16' adjacent the secondary impeller 42 has a diameter which increases smoothly from a minimum diameter to a maximum diameter in the rearward axial direction, the minimum diameter of the circumferential external surface of the adjacent section of stator hub 16' being substantially equal to or slightly greater than the maximum diameter of the circumferential external surface of the hub of secondary impeller 42.

The drive shaft 10', primary impeller 28, impeller shaft 30, and rear beveled gear 34 rotate in unison about the common axis of shafts 10' and 30 and form a first assembly. The secondary impeller 42 and forward beveled gear 38 form a second assembly which is also rotatable about the shaft axis. In accordance with the preferred embodiment, the first and second assemblies are coupled by a beveled pinion 36 which is an idler. Beveled pinion 36 comprises a shaft and a multiplicity of teeth. The teeth of the pinion 36 are meshed with teeth of the forward and rear beveled gears. The beveled pinion 36 is rotatably supported by a needle bearing 62 installed in the hollow strut 17 and by a radial thrust bearing 64 installed between the pinion and the stator hub 16'. The axis of rotation of the pinion 36 is generally perpendicular to the axis of rotation of the impeller shaft 30. The pinion 36 converts rotation of the first assembly in one direction into counter-rotation of the second assembly in an opposite direction. The result is that the primary and secondary impellers will rotate in opposite directions, the swirling effect of one impeller at least partially canceling the swirling effect of the other impeller, thereby enabling the use of stator vanes which are substantially straight. The primary and secondary impellers could turn at different speeds by providing gears with different gear ratios running off the same pinion and on the same centerline. To the extent that the swirling effect of the primary impeller is not substantially canceled by the secondary impeller, the stator vanes may alternatively be curved.

While the invention has been described with reference to preferred embodiments, it will be understood by those skilled in the art that various changes may be made and equivalents may be substituted for elements thereof without departing from the scope of the invention. The person skilled in the art will recognize that the unit shown in FIG. 2 can be mounted to a water tunnel and driven by an inboard motor via the drive shaft 10'. Alternatively, the unit can be mounted to and driven by an outboard motor by means of a generally vertical drive shaft coupled to the shaft of the pinion 36. Furthermore, although not shown in FIG. 2, it should be apparent that either the housing 22' may be an assembly comprising an impeller housing surrounding the impellers and a stator housing surrounding the hub 16'. In addition, the housing 22' may comprise a separate inlet housing for the intake of water. In other words, the housing 22' for the water jet propulsion system may comprise one unitary structure which functions as an inlet housing, an impeller housing, a stator housing and an exit nozzle, or may comprise separate components. Similarly, the first and second assemblies could be unitary cast structures instead of assemblies of components.

In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "housing" comprises one or more attached parts having an inlet and an outlet for flow-through of fluid. For example, the "housing" may comprise a water tunnel or inlet housing, an impeller duct or housing, a stator housing, and an exit nozzle. However, the present invention encompasses forming all of these components as one piece or separate components. For example, the stator housing and the exit nozzle may be formed as one piece or separate components. All such variations fall within the meaning of "housing" as that term is used in the claims.

What is claimed is:

1. A water jet apparatus comprising:

a flow-through housing;

a hub installed inside said housing;

a shaft extending inside said hub and rotatable relative to said hub;

a first impeller secured to said shaft;

a second impeller rotatable relative to said shaft and relative to said hub, said first and second impellers being coaxial; and a gear train arranged to cause said second impeller to rotate in a first direction in response to rotation of said shaft in a second direction opposite to said first direction, wherein said gear train is located to the rear of a rearmost one of said first and second impellers.

2. The water jet apparatus as recited in claim 1, further comprising a plurality of vanes, wherein said hub is supported inside said housing by said vanes.

3. The water jet apparatus as recited in claim 2, wherein each of said vanes is substantially straight.

4. The water jet apparatus as recited in claim 1, wherein said gear train comprises a first gear secured to said impeller shaft, a pinion rotatable relative to said hub and meshed with said first gear, and a second gear rotatable relative to said hub and relative to said shaft and meshed with said pinion.

5. The water jet apparatus as recited in claim 4, wherein said second gear comprises a sleeve coaxial with said shaft, said second impeller being securely mounted to said sleeve.

6. The water jet apparatus as recited in claim 5, wherein said sleeve of said second gear comprises a threaded external surface, further comprising a threaded collar screwed onto said threaded external surface of said sleeve and in abutment with said second impeller.

7. The water jet apparatus as recited in claim 4, further comprising a first set of bearings seated between said shaft and said second gear and a second set of bearings seated between said second gear and said hub.

8. The water jet apparatus as recited in claim 4, further comprising a bearing retainer attached to said hub, and a first set of tapered bearings seated between said first gear and said bearing retainer.

9. The water jet apparatus as recited in claim 8, further comprising a fastener coupled to said first gear, and a second set of tapered bearings seated between said fastener and said bearing retainer.

10. The water jet apparatus as recited in claim 8, further comprising a tail cone in a position abutting said hub, and a set of fasteners coupled to said tail cone and to said bearing retainer for holding said tail cone in said abutting position.

11. The water jet apparatus as recited in claim 4, further comprising a set of radial thrust bearings seated between said second gear and said hub.

12. The water jet apparatus as recited in claim 4, further comprising a drive shaft coupled to said first impeller.

13. The water jet apparatus as recited in claim 4, wherein said first impeller comprises an impeller hub secured to an end of said shaft and a plurality of impeller blades connected to said impeller hub, further comprising a drive shaft coupled to said impeller hub whereby said drive shaft and said first impeller rotate in unison in the same direction.

14. The water jet apparatus as recited in claim 13, wherein said second impeller comprises an impeller hub secured to said second gear and a plurality of impeller blades connected to said impeller hub, said impeller hub of said first impeller comprises a first circumferential flow guide surface having a diameter which increases smoothly from a minimum diameter to a maximum diameter in an axial direction, and said impeller hub of said second impeller comprises a second circumferential flow guide surface having a diameter which increases smoothly from a minimum diameter to a maximum diameter in said axial direction, said minimum diameter of said second circumferential flow guide surface being approximately equal to or slightly greater than said maximum diameter of said first circumferential flow guide surface.

15. The water jet apparatus as recited in claim 14, wherein said hub comprises a third circumferential flow guide surface having a diameter which increases smoothly from a minimum diameter to a maximum diameter in said axial direction, said minimum diameter of said third circumferential flow guide surface being approximately equal to or slightly greater than said maximum diameter of said second circumferential flow guide surface.

16. A water jet apparatus comprising:

a duct comprising a nozzle having an outlet;

a hub installed inside said duct and arranged to provide a generally annular flow region between said hub and said duct which is in flow communication with said nozzle outlet;

a first structure rotatable relative to said hub about an axis, said first structure comprising a first plurality of impeller blades, a first multiplicity of gear teeth, and a shaft which is coaxial with said axis and extends between said first plurality of impeller blades and said first multiplicity of gear teeth;

a second structure rotatable relative to said hub and relative to said first structure about said axis, said second structure comprising a second plurality of impeller blades and a second multiplicity of gear teeth; and a mechanism for coupling said first multiplicity of gear teeth to said second multiplicity of gear teeth to cause said second plurality of impeller blades to rotate in a first direction in response to rotation of said first structure in a second direction opposite to said first direction, wherein said first and second multiplicities of gear teeth are housed inside said hub and are located to the rear of said first and second pluralities of impeller blades.

17. The water jet apparatus as recited in claim 16, further comprising a plurality of vanes, wherein said hub is supported inside said duct by said vanes.

18. The water jet apparatus as recited in claim 16, wherein said first structure comprises a first impeller having said first plurality of impeller blades and secured to said shaft, and a first gear having said first multiplicity of gear teeth and secured to said shaft.

19. The water jet apparatus as recited in claim 18, wherein said second structure comprises a second gear having said second multiplicity of gear teeth and a second impeller having said second plurality of impeller blades and secured to said second gear.

20. The water jet apparatus as recited in claim 16, wherein said coupling mechanism comprises a pinion meshed with said first and second multiplicities of gear teeth.

21. The water jet apparatus as recited in claim 19, wherein said second gear comprises a sleeve coaxial with said impeller shaft, said second impeller being securely mounted to said sleeve.

22. The water jet apparatus as recited in claim 16, further comprising a drive shaft coupled to said first structure.

23. The water jet apparatus as recited in claim 19, wherein said first impeller comprises a first impeller hub secured to an end of said impeller shaft, said first plurality of impeller blades being connected to said first impeller hub, and said second impeller comprises a second impeller hub secured to said second gear, said second plurality of impeller blades being connected to said second impeller hub.

24. The water jet apparatus as recited in claim 23, wherein said first impeller hub comprises a first circumferential flow guide surface having a diameter which increases smoothly from a minimum diameter to a maximum diameter in an axial direction, and said second impeller hub comprises a second circumferential flow guide surface having a diameter which increases smoothly from a minimum diameter to a maximum diameter in said axial direction, said minimum diameter of said second circumferential flow guide surface being approximately equal to or slightly greater than said maximum diameter of said first circumferential flow guide surface.

25. The water jet apparatus as recited in claim 24, wherein said hub comprises a third circumferential flow guide surface having a diameter which increases smoothly from a minimum diameter to a maximum diameter in said axial direction, said minimum diameter of said third circumferential flow guide surface being approximately equal to or slightly greater than said maximum diameter of said second circumferential flow guide surface.

26. A water jet apparatus comprising:

a duct having an inlet and an outlet;

first and second impellers rotatably installed within said duct;

first drive means for rotating said first impeller in a first direction; and second drive means for rotating said second impeller in a second direction opposite to said first direction concurrently with rotation of said first impeller in said first direction, wherein at least a portion of said second drive means is located to the rear of a rearmost one of said first and second impellers.

27. The water jet apparatus as recited in claim 26, wherein said first drive means comprise a drive shaft coupled to said first impeller.

28. The water jet apparatus as recited in claim 26, wherein said second drive means comprise:

an impeller shaft secured to said first impeller; and a gear train coupling said impeller shaft to said second impeller for counter-rotation.

29. The water jet apparatus as recited in claim 28, wherein said gear train comprises a first gear secured to said impeller shaft, a second gear secured to said second impeller, and a pinion meshed with said first and second gears.

30. A water jet apparatus comprising:

a duct having an inlet and an outlet;

first and second impellers rotatably installed within said duct; and an assembly for rotating said first and second impellers in opposite directions, wherein said assembly extends to the rear of a rearmost one of said first and second impellers.

31. The water jet apparatus as recited in claim 30, further comprising a drive shaft coupled to said first impeller.

32. The water jet apparatus as recited in claim 30, wherein said assembly comprises:

an impeller shaft secured to said first impeller; and a gear train coupling said impeller shaft to said second impeller for counter-rotation.

33. The water jet apparatus as recited in claim 32, wherein said gear train comprises a first gear secured to said impeller shaft, a second gear secured to said second impeller, and a pinion meshed with said first and second gears.

34. A water jet propulsion unit comprising:

a duct having an inlet and an outlet;

a first structure which is rotatably installed within said duct for rotation about an axis, said first structure comprising a first multiplicity of impeller blades, a shaft extending to the rear of said first multiplicity of impeller blades, and a first gear secured to an end of said shaft and located to the rear of said first multiplicity of impeller blades;

a second structure which is rotatably installed within said duct for rotation about said axis, said second structure comprising a second multiplicity of impeller blades located to the rear of said first multiplicity of impeller blades, and a second gear located to the rear of said second multiplicity of impeller blades, but forward of said first gear; and a mechanism for coupling said first gear to said second gear in a manner which causes said second structure to rotate in a direction opposite to said first structure.

35. The water jet propulsion unit as recited in claim 34, wherein said mechanism comprises a pinion.

36. The water jet propulsion unit as recited in claim 34, further comprising a housing installed within said duct, wherein at least a portion of said mechanism is housed within said housing.

37. The water jet propulsion unit as recited in claim 34, further comprising a generally horizontal drive shaft coupled to said first structure.

* * * * *